US010514154B2

(12) United States Patent
Jurik et al.

(10) Patent No.: US 10,514,154 B2
(45) Date of Patent: Dec. 24, 2019

(54) MULTISOURCE BEAM SHAPING SYSTEM

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 103 days.

(21) Appl. No.: 14/386,316

(22) PCT Filed: Mar. 18, 2013

(86) PCT No.: PCT/US2013/032850

§ 371 (c)(1),
(2) Date: Sep. 18, 2014

(87) PCT Pub. No.: WO2013/142436

PCT Pub. Date: Sep. 26, 2013

(65) Prior Publication Data

US 2019/0170330 A1 Jun. 6, 2019

Related U.S. Application Data

(60) Provisional application No. 61/612,374, filed on Mar. 18, 2012.

(51) Int. Cl.

| | |
|---|---|
| ***F21V 14/06*** | (2006.01) |
| ***F21V 5/04*** | (2006.01) |
| ***F21V 17/02*** | (2006.01) |
| ***F21V 23/04*** | (2006.01) |
| *F21W 131/406* | (2006.01) |
| *F21Y 105/10* | (2016.01) |
| *F21Y 115/10* | (2016.01) |

(52) U.S. Cl.
CPC ..... *F21V 14/06* (2013.01); *F21V 5/04* (2013.01); *F21V 17/02* (2013.01); *F21V 23/0435* (2013.01); *F21W 2131/406* (2013.01); *F21Y 2105/10* (2016.08); *F21Y 2115/10* (2016.08)

(58) Field of Classification Search
CPC . F21V 14/06; F21V 5/04; F21V 17/02; F21V 23/0435
See application file for complete search history.

(56) References Cited

U.S. PATENT DOCUMENTS 5,665,305 A 9/1997 Belliveau et al.
5,754,896 A 5/1998 Aoki et al.
(Continued)

FOREIGN PATENT DOCUMENTS

CN 1189669 A 8/1998
CN 1253300 A 5/2000
(Continued)

OTHER PUBLICATIONS

PCT International Search Report; Application No. PCT/US2013/032850; dated Jul. 23, 2013; 5 pages.
(Continued)

*Primary Examiner* — Anne M Hines
(74) *Attorney, Agent, or Firm* — Conley Rose, P.C.; Grant Rodolph; Brooks W Taylor

(57) ABSTRACT

Described is an improved automated multisource LED array luminaire with an array-wide, rotating beam shaper.

13 Claims, 9 Drawing Sheets

(56) References Cited

U.S. PATENT DOCUMENTS

| | | | | |
|---|---|---|---|---|
| 5,758,955 | A | 6/1998 | Belliveau | |
| 5,980,066 | A | 11/1999 | Belliveau et al. | |
| 6,048,080 | A | 4/2000 | Belliveau | |
| 7,896,521 | B2 | 3/2011 | Becker et al. | |
| 2006/0187654 | A1 | 8/2006 | Jungel-Schmid et al. | |
| 2008/0273324 | A1* | 11/2008 | Becker | F21V 14/06 362/237 |
| 2009/0310356 | A1* | 12/2009 | Laporte | F21V 5/007 362/239 |
| 2010/0123954 | A1 | 5/2010 | Benitez et al. | |
| 2011/0085326 | A1 | 4/2011 | Jouffrieau | |

FOREIGN PATENT DOCUMENTS

| | | | |
|---|---|---|---|
| WO | 2012020597 | A1 | 2/2012 |
| WO | 2012031598 | A1 | 3/2012 |

OTHER PUBLICATIONS

PCT Written Opinion of the International Searching Authority; Application No. PCT/US2013/032850; dated Jul. 23, 2013; 4 pages.
Chinese Office Action; Application No. 201380024879.7; dated Feb. 27, 2017; 15 pages.
Chinese Office Action; Application No. 201380024879.7; dated Nov. 28, 2017; 16 pages.
Chinese Notice of Allowance; Application No. 201380024879.7; dated May 3, 2018; 3 pages.
European Intention to Grant; Application No. 13724917.3; dated Mar. 22, 2016; 8 pages.
European Intention to Grant; Application No. 13724917.3; dated Oct. 14, 2016; 6 pages.
Jurik, Pavel, et al.; U.S. Appl. No. 16/517,335; Filing Date: Jul. 19, 2019; Title: Modular Multisource Beam Shaping System; 31 pages.
Notice of Allowance dated Sep. 13, 2019; U.S. Appl. No. 16/517,335 filed Jul. 19, 2019; 15 pages.

* cited by examiner

MULTISOURCE BEAM SHAPING SYSTEM

CROSS-REFERENCE TO RELATED APPLICATION

This application is a U.S. National Stage of International Patent Application No. PCT/US13/32850 filed Mar. 18, 2013 which claims priority to U.S. Provisional Application No. 61/612,374 filed on Mar. 18, 2012.

TECHNICAL FIELD OF THE DISCLOSURE

The present disclosure generally relates to automated luminaire(s), specifically to a beam shaper for use with an automated luminaire(s).

BACKGROUND OF THE DISCLOSURE

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern. The beam pattern is often provided by a stencil or slide called a gobo which may be a steel, aluminum, or etched glass pattern. The products manufactured by Robe Show Lighting such as the ColorSpot 700E are typical of the art.

The optical systems of such luminaires may include a beam shaping optical element through which the light is constrained to pass. A beam shaping element may comprise an asymmetric or lenticular lens or collection of lenses that constrain a light beam that is symmetrical and circular in cross section to one that is asymmetrical and predominantly elliptical or rectangular in cross section. A prior art automated luminaire may contain a plurality of such beam shapers each of which may have a greater or lesser effect on the light beam and that may be overlapped to produce a composite effect. For example a weak beam shaper may constrain a circular beam that has a symmetrical beam angle of 20° in all directions into a primarily elliptical beam that has a major axis of 30° and a minor axis of 15°. A more powerful beam shaper may constrain a circular beam that has a symmetrical beam angle of 20° in all directions into a primarily elliptical beam that has a major axis of 40° and a minor axis of 100. It is also common in prior art luminaires to provide the ability to rotate the beam shaper along the optical axis such that the resultant symmetrical elliptical beam may also be rotated. U.S. Pat. Nos. 5,665,305; 5,758,955; 5,980,066; and 6,048,080 disclose such a system where a plurality of discrete lens elements is used to control the shape of a light beam.

FIG. 1 illustrates a typical multiparameter automated luminaire system 10. These systems commonly include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each automated luminaire 12 is connected in series or in parallel to data link 14 to one or more control desks 15. The automated luminaire system 10 is typically controlled by an operator through the control desk 15.

Prior art beam shapers often require installation internally within the luminaire and are not suitable for optical systems where an array of a number of discrete emitters, such as Light Emitting Diodes (LEDs), is used to produce the beam. Instead they rely on the optical path having a focus point that is small compared to the overall diameter of the beam in which the beam shaping can be situated.

There is a need for an improved beam shaper mechanism for automated luminaires that is simple to install or remove from a luminaire, which provides the ability to smoothly and continuously adjust the angle of eccentricity of the constrained light beam for a light beam produced by an array of discrete emitters such as LEDs.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the FIGUREs, like numerals being used to refer to like and corresponding parts of the various drawings.

The present disclosure generally relates to an automated luminaire, specifically to the configuration of a beam shaper within such a luminaire such that it provides the ability to adjust the size or eccentricity of the constrained light beam.

Figure 1:
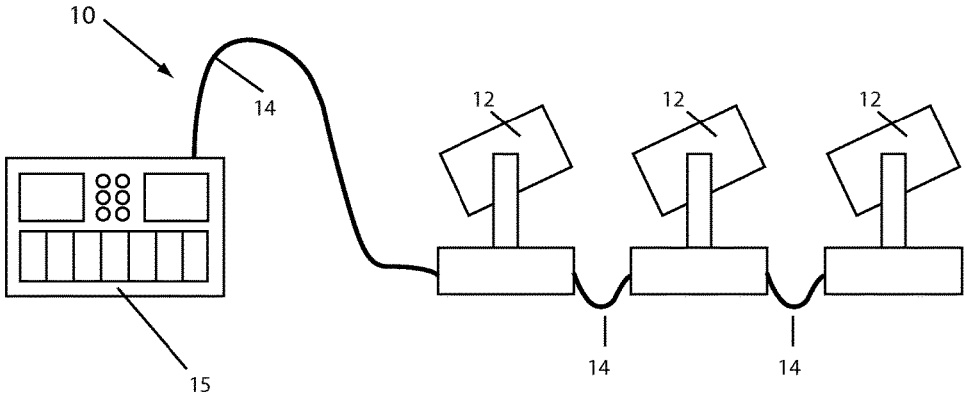
FIG. 1 illustrates a typical multiparameter automated luminaire system.
Figure 2:
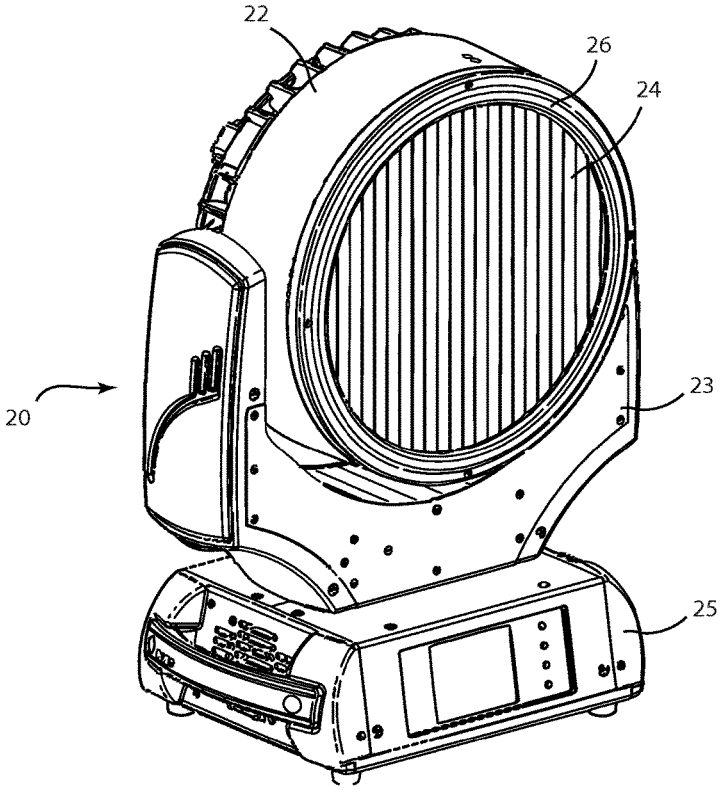
FIG. 2 illustrates an embodiment of the beam shaping system mounted to an automated luminaire.

FIG. 2 illustrates an embodiment of the beam shaping system mounted to an automated luminaire. Automated luminaire 20 comprises base box 25 on which is rotatably mounted yoke assembly 23 which is able to rotate in a first axis relative to base box 25. Luminaire head 22 is rotatably mounted to yoke 23 and is able to rotate in a second axis relative to yoke 23. Beam shaper 24 is mounted in rotatable frame 26 to the front of luminaire head 22. Beam shaper 24 may be rotated around the optical axis of luminaire head 22.

Figure 3:
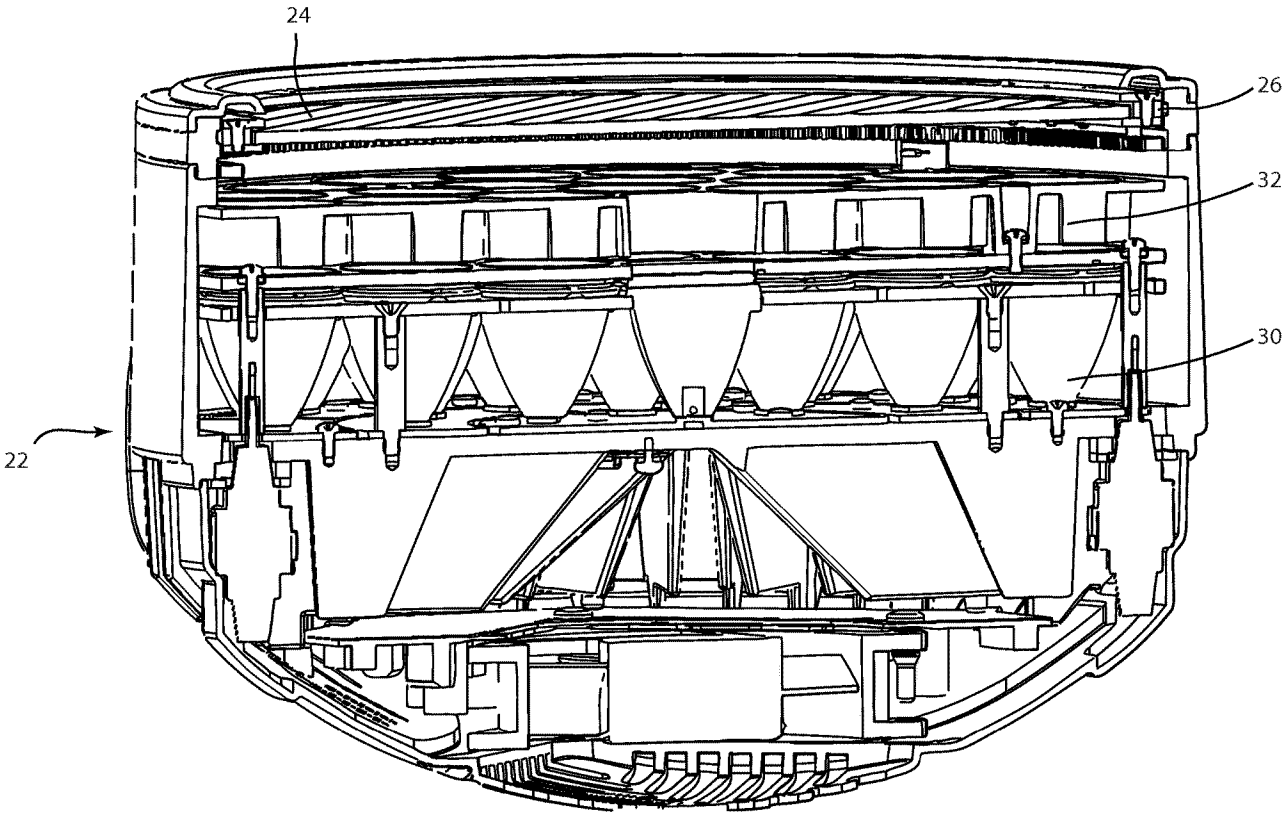
FIG. 3 illustrates a cross sectional view of the beam shaping system mounted to an automated luminaire.
Figure 4:
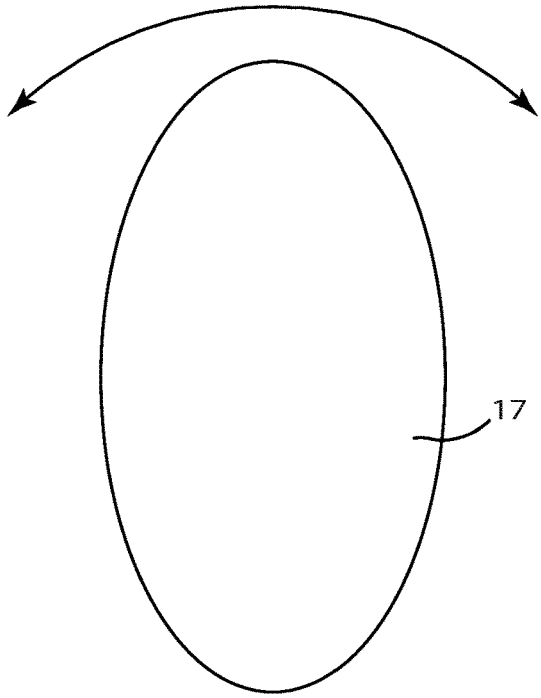
FIG. 4 illustrates a light beam after modulation by a beam shaper.
Figure 5:
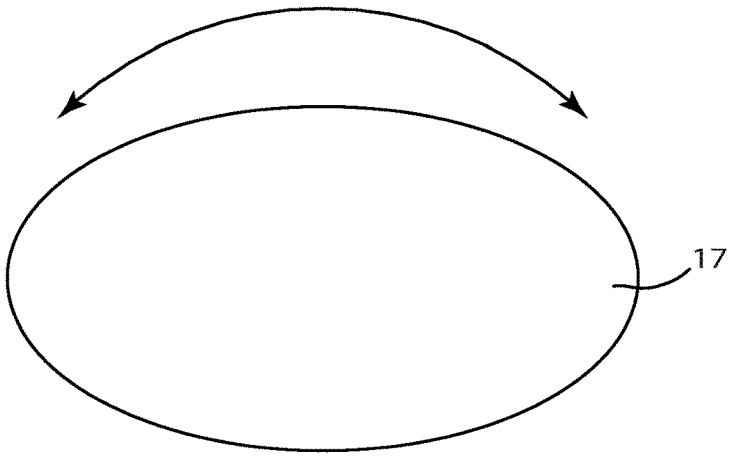
FIG. 5 illustrates a light beam after modulation by a beam shaper.

FIG. 3 illustrates a cross sectional view through luminaire head 22. An array of discrete LED emitters 30 and their associated individual optical systems 32 produce multiple beams of light each of which passes through beam shaper 24. Transmissive beam shaper 24 is mounted in rotatable frame 26 to the front of luminaire head 22. Beam shaper 24 may be rotated around the optical axis of luminaire head 22. In one embodiment, beam shaper 24 may comprise a disk of optically transparent material such as glass, acrylic, or polycarbonate that is embossed or molded with a pattern or array of raised or lowered linear areas to form an array of ribbed or lenticular lenses. When the substantially circular light beam passes through this ribbed or lenticular lens the cross section of that beam will be constrained to a cross section 17 that is asymmetrical and predominantly elliptical or rectangular in shape as shown in FIG. 4. Such a system may be rotated around an axis parallel with the optical axis of the luminaire to rotate the elliptical beam shown in FIG. 4 to the position shown in FIG. 5. The beam shaper 24 may be continuously rotated a full 360° to produce any intermediate result. The user may choose and replace beam shaper 24 with different beam shapers that produce different results in the output beam. For example, beam shapers that produce light beams with a greater or smaller eccentricity angle, asymmetric beam shapers that affect the beam in just one direction, prismatic beam shapers, diffusion beam shapers, holographic beam shapers, lenslet beam shapers, or other beam shapers as known in the art. The system could also be used as a beam diverter using a beam shaper that deflects the light axis through an angle.

Figure 6:
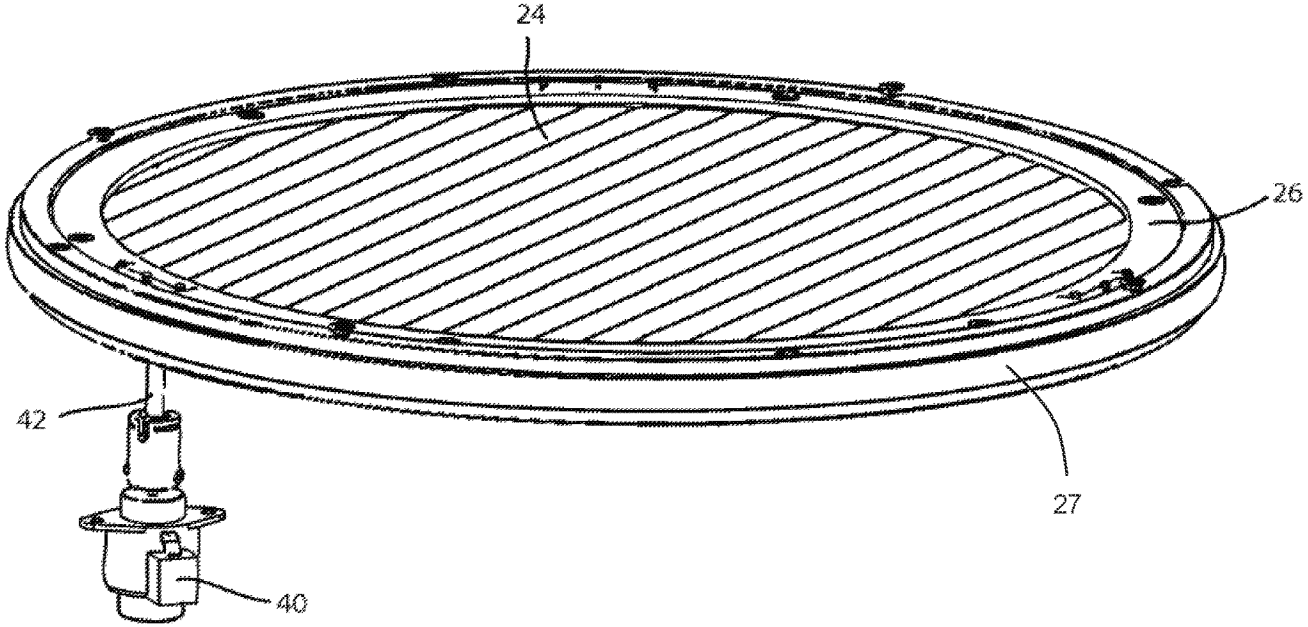
FIG. 6 illustrates an embodiment of the beam shaping system.
Figure 7:
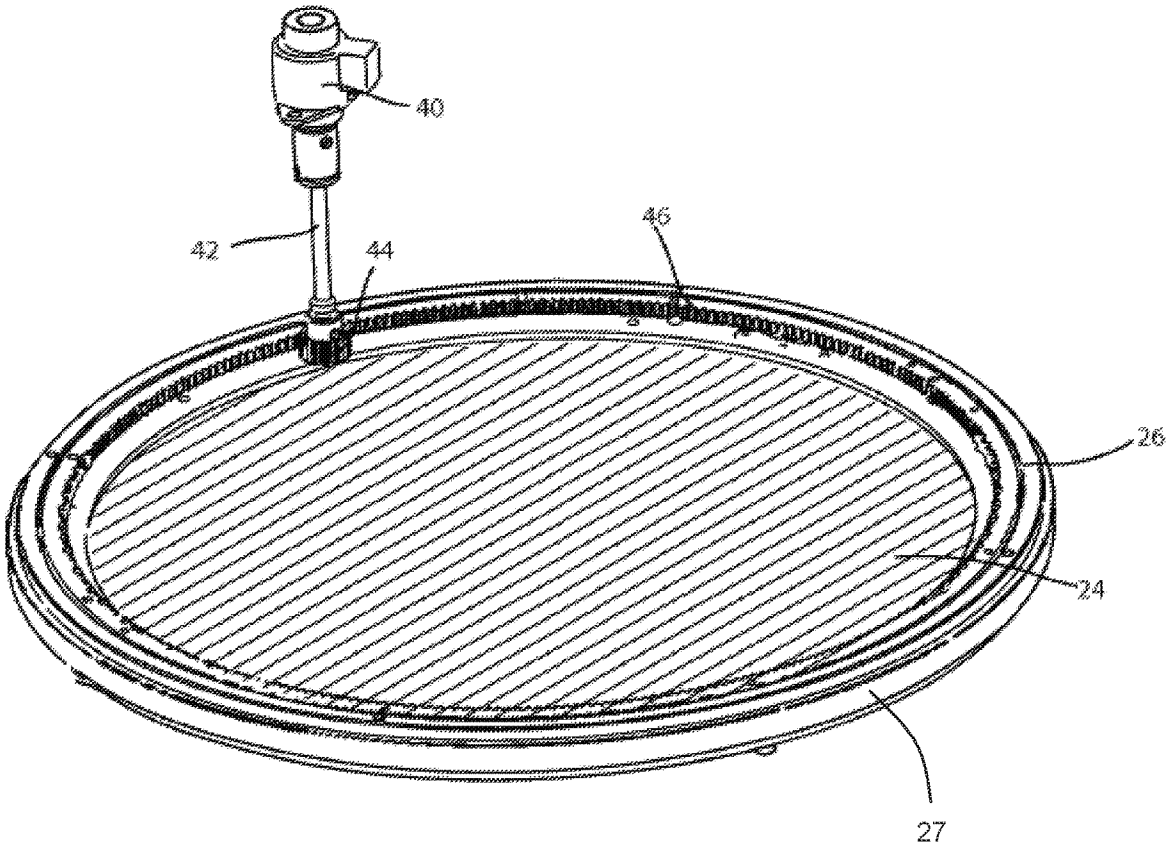
FIG. 7 illustrates an embodiment of the beam shaping system.
Figure 8:
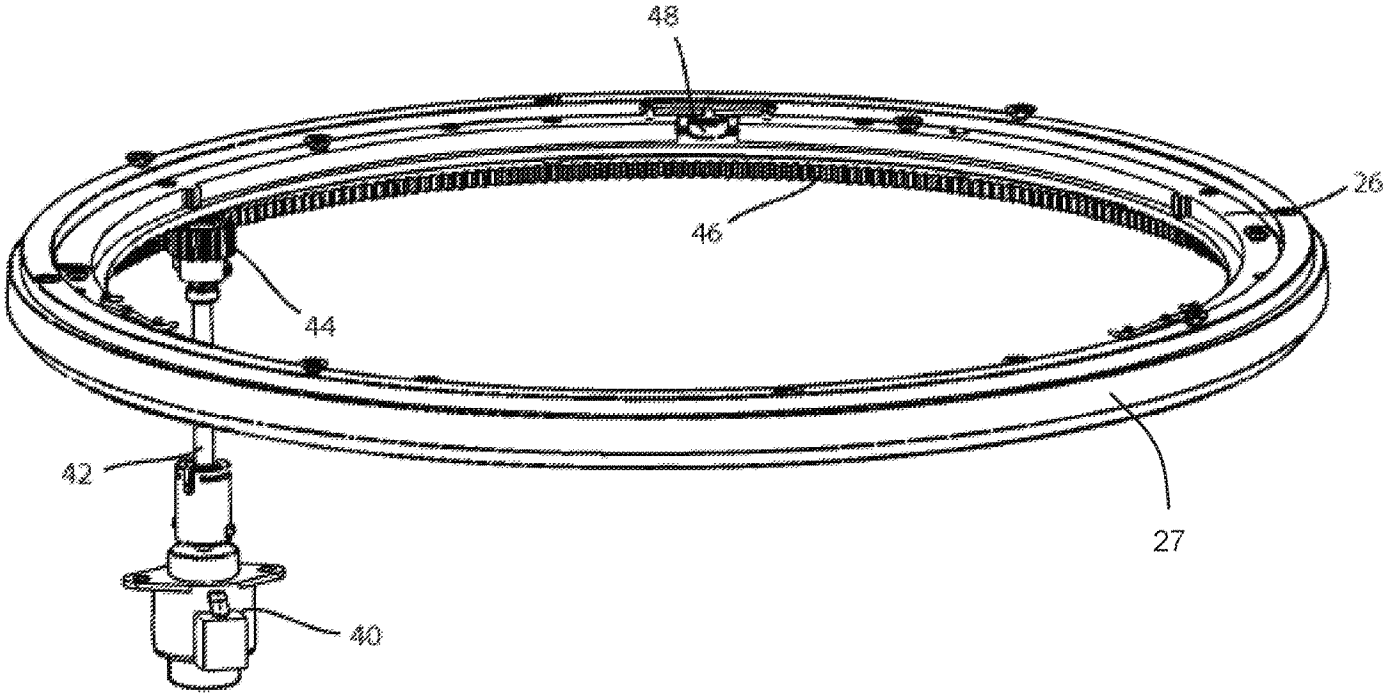
FIG. 8 illustrates an embodiment of the beam shaping system.

FIGS. 6, 7 and 8 illustrate an embodiment of the beam shaping system removed from the luminaire for clarity. Beam shaper 24 is mounted within rotatable frame 26. Motor 40 drives shaft 42 and thus pinion gear 44. Pinion gear 44 in turn engages with and drives ring gear 46 which is part of rotatable frame 26. Rotatable frame 26 is free to rotate within bearings 48 that are mounted to fixed frame 27. Because of the large gear ratio between pinion gear 44 and ring gear 46, rotatable frame 26 may be rotated smoothly and positioned accurately. Motor 40 may be a stepper motor, or other motor known in the art such as a servo motor.

Figure 9:
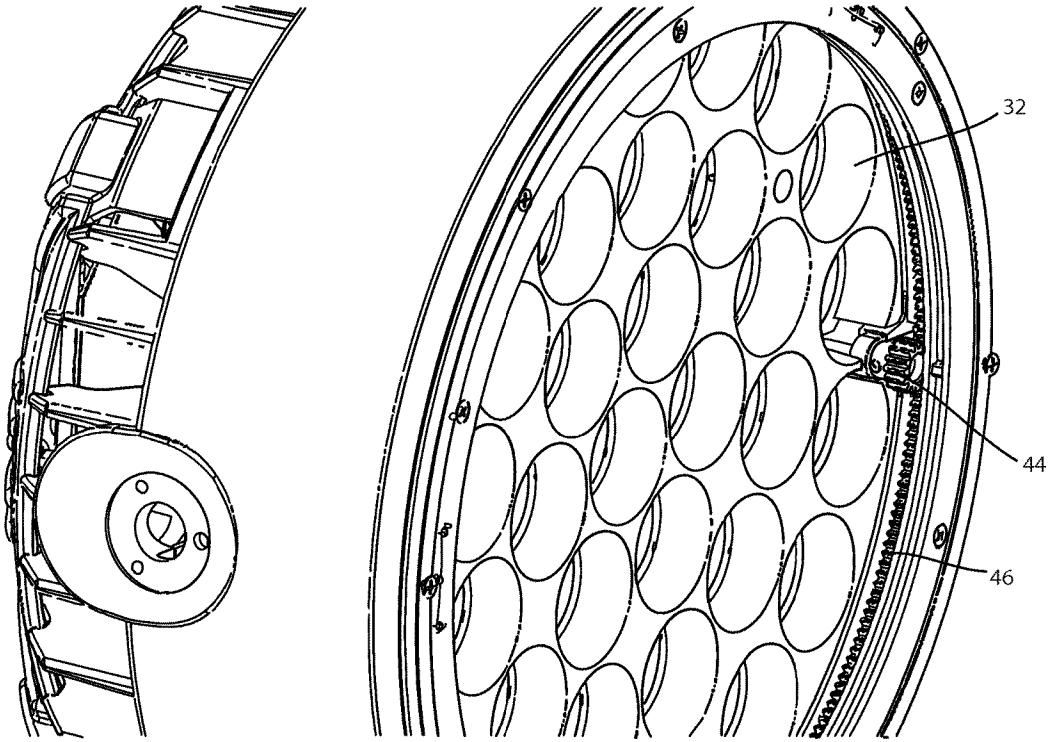
FIG. 9 illustrates an embodiment of the beam shaping system mounted to an automated luminaire.
Figure 10:
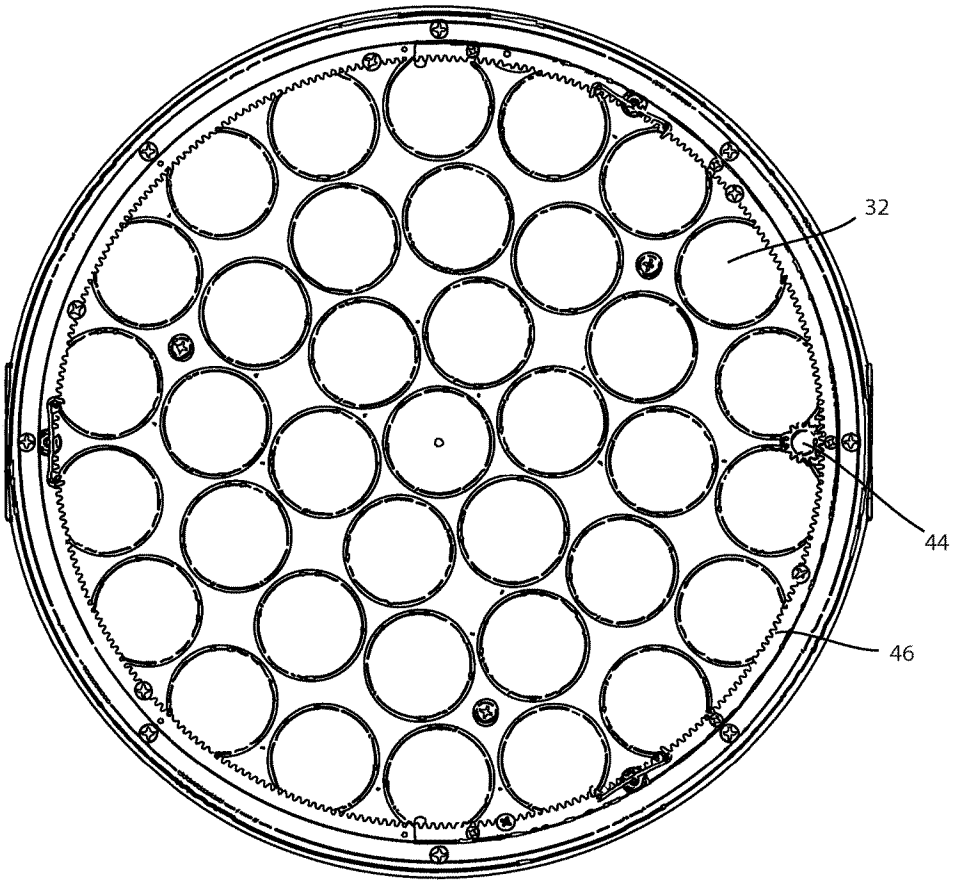
FIG. 10 illustrates an elevation view of an embodiment of the beam shaping system mounted to an automated luminaire.

FIGS. 9 and 10 illustrate an embodiment of the beam shaping system as mounted to an automated luminaire. In this figure the beam shaper 24 is omitted to allow the construction to be seen. Pinion gear 44 engages with and drives ring gear 46 so as to rotate the beam shaper (omitted for clarity) in front of the array of LED optical systems 32. Pinion gear 44 is small and does not materially interfere with the light beam from adjacent emitters, nor does the system cause any appreciable increase in the size of the automated luminaire. Such a system is extremely flexible, its position on the outside front of the automated luminaire makes it simple for a user to change the beam shaper to any design that they wish in order to achieve the desired effect. Alternatively, it can easily be completely removed to allow the system to revert back to its native beam shape.

Figure 11:
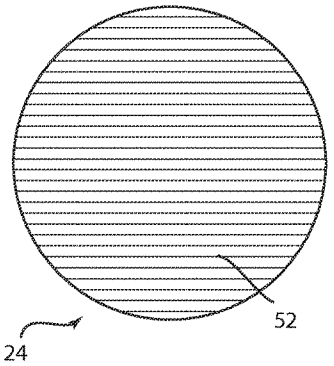
FIGS. 11-16 illustrate embodiments of the beam shaper.
Figure 12:
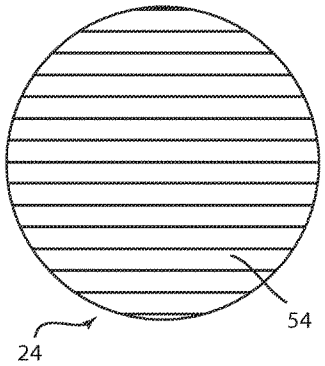
Figure 13:
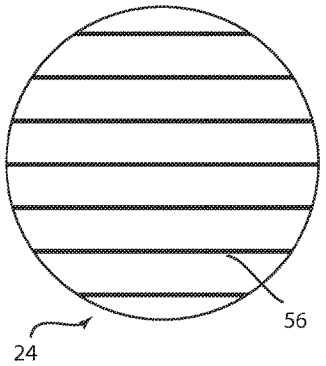
Figure 14:
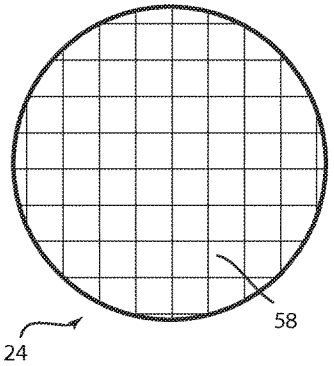
Figure 15:
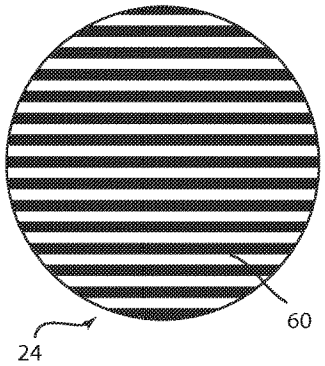
Figure 16:
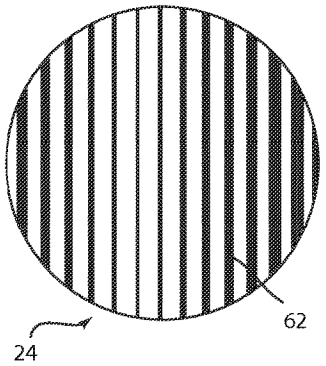

FIGS. 11-16 show embodiments of the beam shaper 24. FIGS. 11, 12 and 13 represent beam shapers having differing angles, where beam shaper 52 is a wide angle asymmetric lens array, beam shaper 54 is a medium angle asymmetric lens array, and beam shaper 56 is a narrow angle asymmetric lens array. FIGS. 14, 15 and 16 are examples of still other beam shapers that may be used. Beam shaper 58 is a grid array of lenticular lenses, beam shaper 60 is a linear array of prisms forming an offset beam, and beam shaper 62 is a linear array of random angle prisms forming a complex asymmetric beam. In every case the beam shaper 24 may be rotated so as to rotate the effect produced.

In an alternative embodiment (not shown) the beam shaper 24 could be a portion of a disc instead of a full disc so that it only covers and affects a portion of the LEDs.

It should be appreciated that in any cases where articulation of elements is called for herein but not shown, it is well within the known art to provide a variety of mechanisms that can achieve these necessary articulations.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

The invention claimed is:

1. An automated luminaire comprising:

a plurality of light sources configured in a multisource array to produce a plurality of beams of light corresponding to the plurality of light sources; and a transmissive beam shaper spanning the multisource array, the transmissive beam shaper configured for rotation, the transmissive beam shaper comprising an array of ribbed lenses, each ribbed lens extending across the transmissive beam shaper and receiving light simultaneously from more than one of the beams of light.

2. The automated luminaire of claim 1, wherein the plurality of light sources in the multisource array are Light Emitting Diodes (LEDs).

3. The automated luminaire of claim 1, further comprising control electronics configured to control a rotation of the transmissive beam shaper in response to signals received via a data link from an external device.

4. The automated luminaire of claim 1, wherein the array of ribbed lenses comprises a linear array of prisms.

5. The automated luminaire of claim 4 where the array of prisms comprises prisms with varying angles.

6. The automated luminaire of claim 1, wherein the transmissive beam shaper is removably mounted in the automated luminaire.

7. The automated luminaire of claim 1, further comprising:

a rotatable frame in which is mounted the transmissive beam shaper, the rotatable frame comprising a ring gear facing towards an inner side of the rotatable frame; and a pinion gear configured to engage with the ring gear and drive a rotation of the rotatable frame.

8. The automated luminaire of claim 7, wherein the motor-driven pinion gear is located adjacent to two of the plurality of light sources.

9. The automated luminaire of claim 7, wherein the rotatable frame is configured to rotate within a plurality of bearings that are mounted to a fixed frame of the automated luminaire.

10. The automated luminaire of claim 7, wherein the rotatable frame is configured to rotate continuously.

11. The automated luminaire of claim 7, further comprising a motor configured to rotate the pinion gear.

12. The automated luminaire of claim 11, wherein the motor is a stepper motor.

13. The automated luminaire of claim 11, wherein the motor is electrically coupled to control electronics configured to control a rotation of the motor in response to signals received via a data link from an external device.

* * * * *